US007743973B2

(12) United States Patent
Hegami

(10) Patent No.: US 7,743,973 B2
(45) Date of Patent: Jun. 29, 2010

(54) THUMB-ACTUATED CANDY OR MINT BOX

(76) Inventor: David Todjar Hegami, 4733 Torrance Blvd., Torrance, CA (US) 90505

( * ) Notice: Subject to any disclaimer, the term of this patent is extended or adjusted under 35 U.S.C. 154(b) by 33 days.

(21) Appl. No.: 11/606,737

(22) Filed: Nov. 30, 2006

(65) Prior Publication Data

US 2008/0128480 A1 Jun. 5, 2008

(51) Int. Cl.
*B65D 43/20* (2006.01)

(52) U.S. Cl. ..... 229/129.1; 229/122

(58) Field of Classification Search ..... 229/125.125, 229/129.1, 220, 122, 131.1
See application file for complete search history.

(56) References Cited

U.S. PATENT DOCUMENTS 2,330,926 A * 10/1943 Rous ..... 229/125.15
2,507,430 A * 5/1950 Yancey ..... 229/220
3,033,436 A * 5/1962 Peimer ..... 229/220
3,040,953 A * 6/1962 Tindall ..... 229/220
3,126,141 A * 3/1964 Walter ..... 229/131.1
3,229,888 A * 1/1966 Gillam ..... 229/131.1
3,819,093 A * 6/1974 Forbes, Jr. ..... 229/131.1
4,081,128 A * 3/1978 O'Neill ..... 229/220
4,197,985 A * 4/1980 Austin ..... 229/220
4,609,142 A * 9/1986 Adamek ..... 229/220
5,505,373 A 4/1996 von Stillfried
6,273,332 B1 8/2001 Hengami
6,360,942 B2 3/2002 Hengami
6,435,402 B1 8/2002 Hengami
6,945,449 B2 9/2005 Hengami

* cited by examiner

*Primary Examiner*—Gary E Elkins
(74) *Attorney, Agent, or Firm*—Robert J. Lauson; Lauson & Tarver LLP

(57) ABSTRACT

A novel candy or mints box has an opening near the top of the box and an underlying slide that is moveable sideways across the opening. Preferably the top portion of the box includes a flap with an opening, and the flap extends over a corresponding opening in the front side such that the openings align, and the slide lies between the front side of the box and the top flap. The slide also preferably further includes a stop member and the box has a corresponding catch member, such that the slide is always contained within the box. Advantageously, the box is formed from a single blank piece of paper or cardboard stock, and folded in a particular sequence such that the slide ends up inside the box without the need for a separate insertion step.

8 Claims, 4 Drawing Sheets

THUMB-ACTUATED CANDY OR MINT BOX

BACKGROUND OF THE INVENTION

1. Field of the Invention

The present invention relates to packaging for solid pourable product, and more particularly to a specialty box for conveniently dispensing confectioneries or the like.

2. Description of the Related Art

Clever packaging, from both a functional and aesthetic standpoint, is proven to drive and generate sales. Applicant is the owner of the von Stillfried U.S. Pat. No. 5,505,373 licensed for the popular Certs® mints box, and is the named inventor on numerous U.S. patents directed to specialty packaging including U.S. Pat. Nos. 6,116,499, 6,273,332, 6,360,942, 6,435,402, 6,945,449 and 7,040,528.

Further, Applicant is the inventor of the subject matter disclosed in pending U.S. application Ser. No. 11/321,283 published Jun. 15, 2006 and entitled "Convenient Solid Product Dispensing Package." That application discloses a relatively large candy package of a hexagonal six-sided cross-section and slide opener designed to be held in conventional cup holders in moving vehicles.

While Applicant's packages described in the patents and published applications offer many advantages including being easy opening/closing, most are not truly pocket sized nor easily entirely operable with one hand or have other disadvantages. For example, for the candy/mint boxes disclosed in patents mentioned above, the slide opening operates in conjunction with the top of the box. For these boxes if held upright in one hand and thumb actuated require partially opening the top of the box and the user's thumb tends to block the product being dispensed.

Accordingly, Applicant has continued to develop boxes of new and differing functionality which offer improvements over the prior art including in ease of operation.

OBJECTS OF THE INVENTION

It is an object of the present invention to provide a package that offers a convenient slide opening not tied to the top or bottom of the box.

It is a further object of the present invention to offer a slide opening that moves in a sideways direction perpendicular to the top opening of the box.

It is a further object to provide a package with an opening that is actuated by the user's thumb at the same time not tending to block the opening.

It is a further object to provide a package that is easily held and actuated by a single hand of the user.

It is a further object of the present invention to provide an improved package that can be easily dispensed while the user is driving without overly distracting or interfering with the user's operation of the moving vehicle.

It is an object of the present invention to provide an improved package that can be sized to fit well into a user's pocket.

It is a still further object of the present invention to provide such a box that is inexpensive and easy to manufacture on a mass scale, for example being made from a single sheet of blank stock and constructed in such a way to avoid any insertion step.

These and other objects and advantages of the present invention will become apparent upon reading the following detailed description and upon reference to the accompanying drawings.

SUMMARY OF THE INVENTION

A package for dispensing solid pourable product such as candy or mints includes a box with top and bottom portions and preferably four more major sides, and the box preferably sized to fit inside the user's hand between the user's fingers and thumb as well as in the user's pocket when not in use. One of the major sides has an opening near the top of the box and an underlying slide that is moveable sideways across the opening, started by the user's thumb engaging a tab on the slide. In operation the user may hold the box upright in his or her hand and at the same time actuate the slide sideways, enabling dispensing of contents of the box without the user's thumb blocking the opening.

Preferably the top portion of the box includes a flap with an opening, and the flap extending over the opening in the major side such that the openings align. Preferably the slide lies between the major side of the box with the opening and the top flap. The slide preferably further includes at least one stop member and the box comprises at least one corresponding catch member, such that the slide is always contained between the major side of the box with the opening and the top flap.

The box is formed from a single blank piece of stock that includes a main box portion having top and bottom ends and an opening near the top, and six major sides each generally rectangular shaped and connected to one of the others, one of the major sides having an opening near the top. The blank further includes a generally rectangular top portion connected to the top of the main box portion and at least one bottom portion connected to the bottom of the main box portion, and a slide connected to one of the major sides extending in a direction generally parallel with the top of the main box portion.

Figure 1:
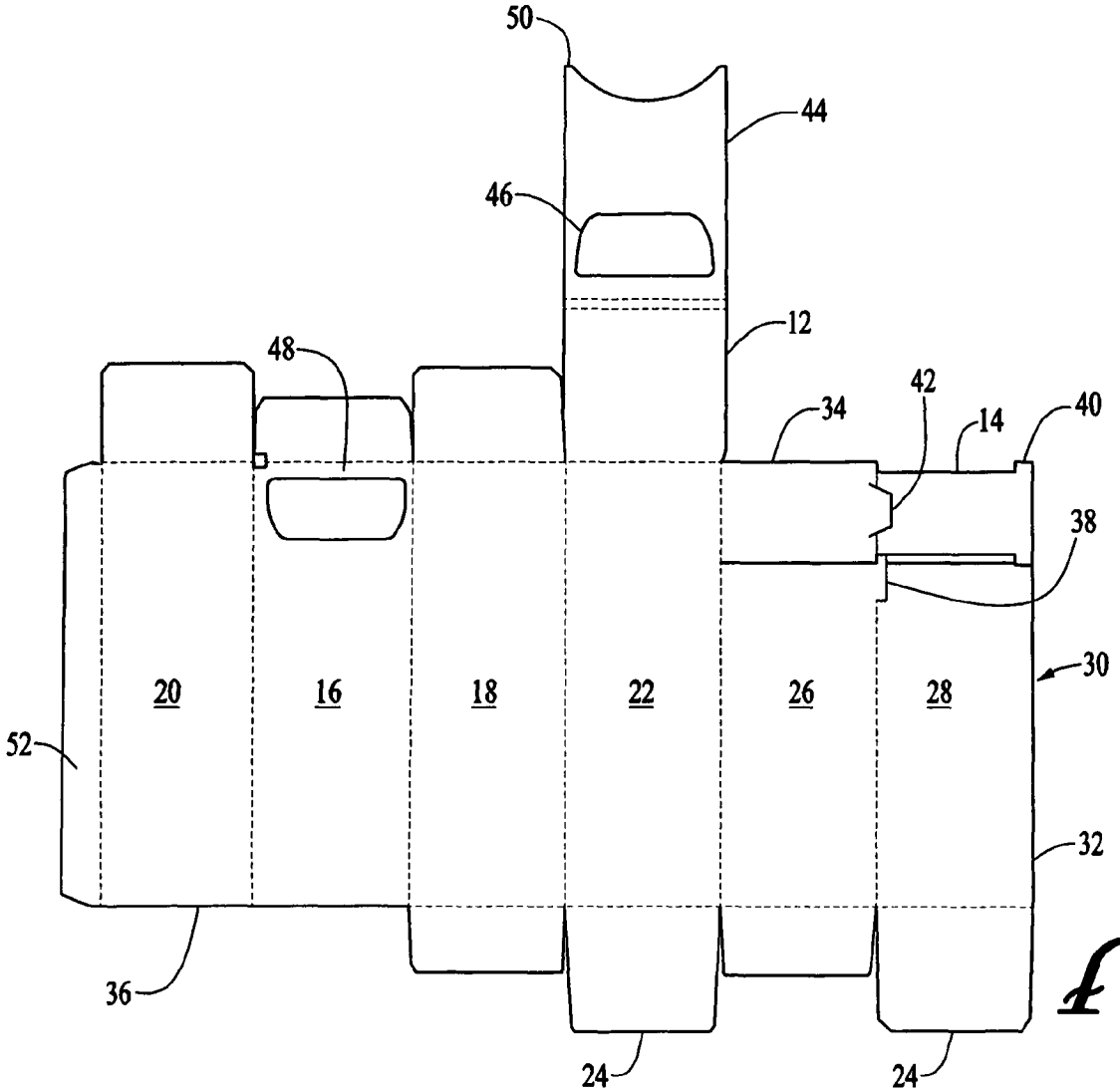
FIG. 1 is a flat pattern view of the blank stock from which the preferred embodiment is made.

LISTING OF REFERENCE NUMERALS FOR PREFERRED EMBODIMENT package or box 10
top portion 12
sideways slide 14
front side 16
right side 18
left side 20
back side 22
bottom portions 24
additional major sides 26, 28
paper stock 30
main box portion 32
top end 34
bottom end 36
catch member 38 stop members 40
thumb tab 42
top flap 44
top opening 46
front opening 48
top ears 50
side tab 52

DESCRIPTION OF THE PREFERRED EMBODIMENT(S)

Figure 2:
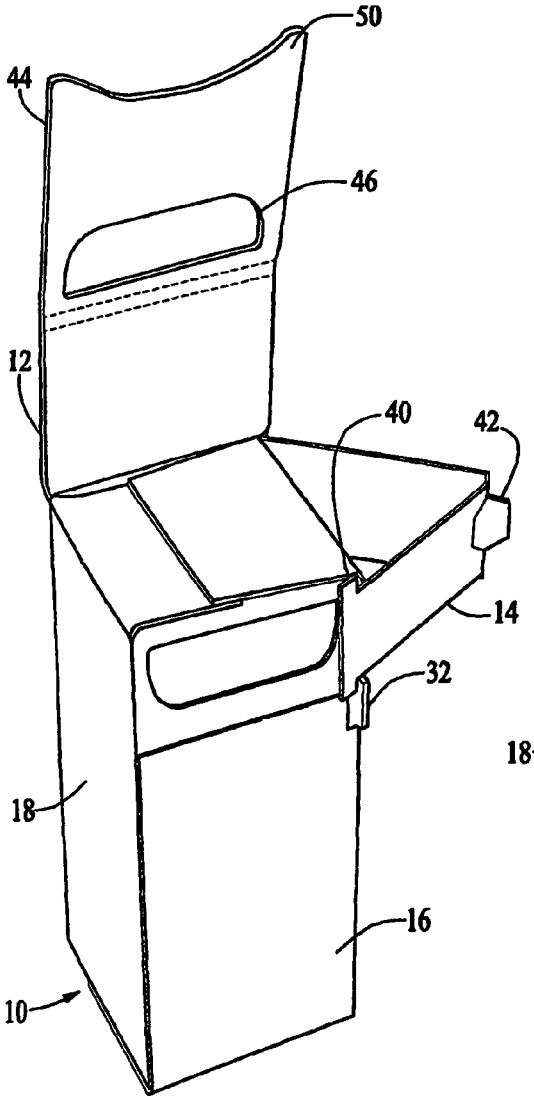
FIG. 2 is a front perspective view of the partially-constructed box of the preferred embodiment showing the structure that provides the sideways slider opening.
Figure 3:
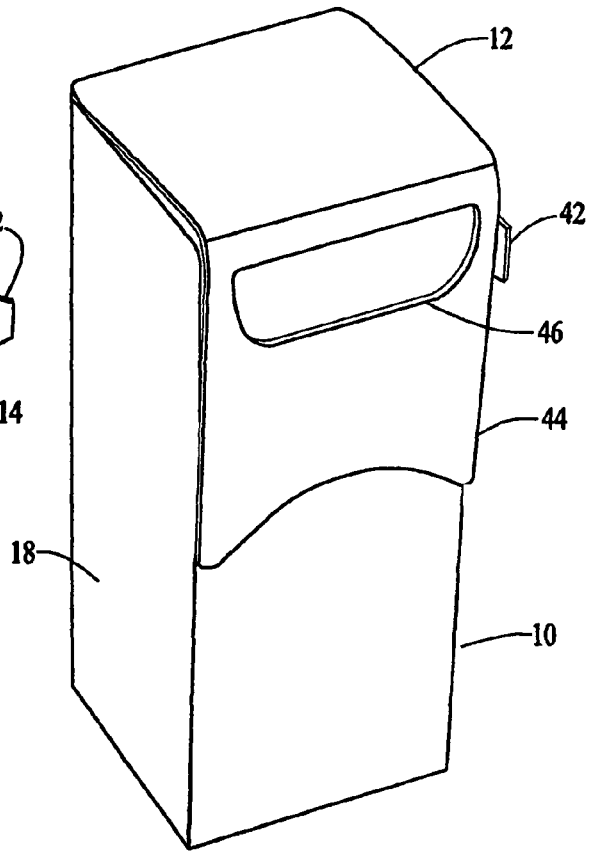
FIG. 3 is a front perspective view of the constructed box closed at the top and bottom.

Referring first to primarily FIGS. 2, 3 the preferred embodiment of the present invention may be described. Shown is a package or box 10 for solid pourable food products such as small candies or mints. FIG. 2 shows the top portion 12 of the box 10 partially disassembled and the underlying slide 14. The box 10 has four major exterior sides including a front side 16, a left side 18, a left side 20 (FIG. 4) and a back side 22 (FIG. 1), and a pair of bottom portions 24 which fold over each other.

FIG. 1 shows a flat pattern of a single blank sheet or paper or cardboard stock 30 used to make the box 10. The main box portion 32 has a top end 34 and a bottom end 36, and is scored for folding between six (6) major sides, 16, 18, 20 and 26, 28, all generally rectangular in shape. Note a portion of major sides 26, 28 is cut away for the slide 14. Additionally, a portion of side 28 is cut away to make a catch member 38 that corresponds in configuration with a par of stop members 40 at the end of the slide 14. The slide 14 also is cut such that when folded it forms a tab 42 configured for engagement by the user's thumb.

The top portion 12 of the box 10 includes a flap 44 with an opening 46, and a corresponding opening 48 is found in the front side 16 of the box 10. As the box 10 is constructed those openings 46, 48 align with one another, and the slide 14 is placed between the top flap 44 and the front side 16 of the box 10. The catch member 38 prevents the advance of the stop members 40 beyond the right major side 20, and hence keeps the slide 14 contained in the box 10. Preferably the top flap 44 has a pair of ears 50 and there is a side tab 52 that may serve as areas to apply glue or other adhesive to hold the constructed box together.

The box 10 is constructed by folding the blank 30 in a particular sequence such that, importantly, no specialized automated packaging machinery is needed to insert the slide member 14 within the box 10. Referring to FIG. 1, the construction begins by folding up the side tab 52 of the blank 30 at the fold line between the side tab 52 and the major side 20 so they are approximately perpendicular to one another, and then similarly folding between sides 20 and 16, then 16 and 18, 18 and 22, 22 and 26 (and 22 and slide 14), and 26 and 28 (and folding across the middle portion of slide 14). Then the other top and bottom flaps are folded over the box 10 including the top flap 44 over the slide 14. In this manner the slide 14 is positioned properly between the top flap 44 and the box 10 such that there is no need for a separate insertion step that may be difficult to accomplish on a mass production basis.

Figure 4:
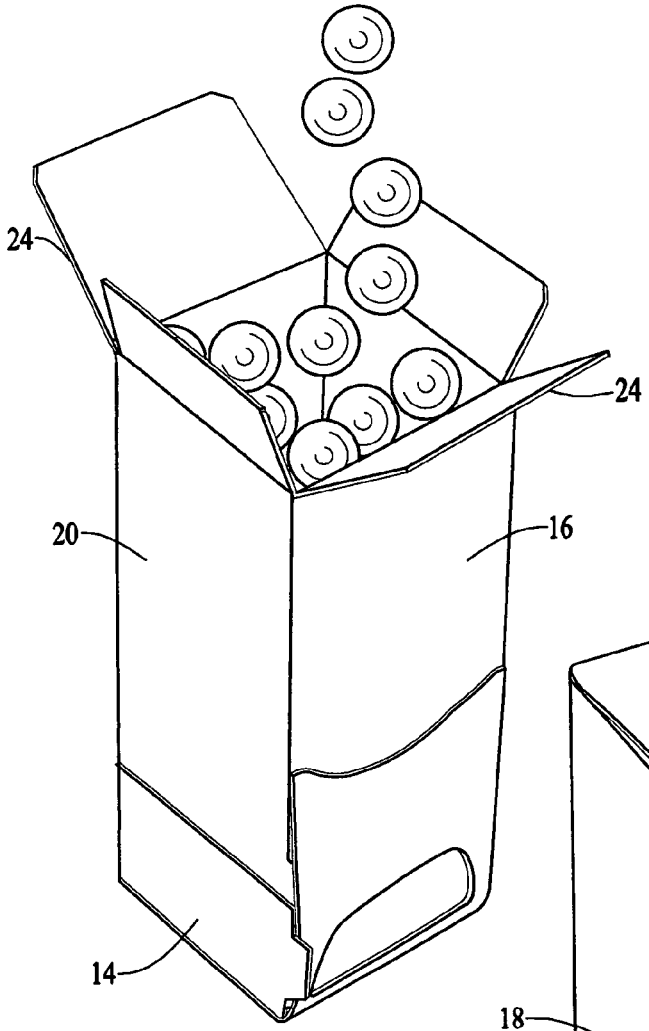
FIG. 4 is an inverted front perspective view of the box being filled from the bottom.
Figure 5:
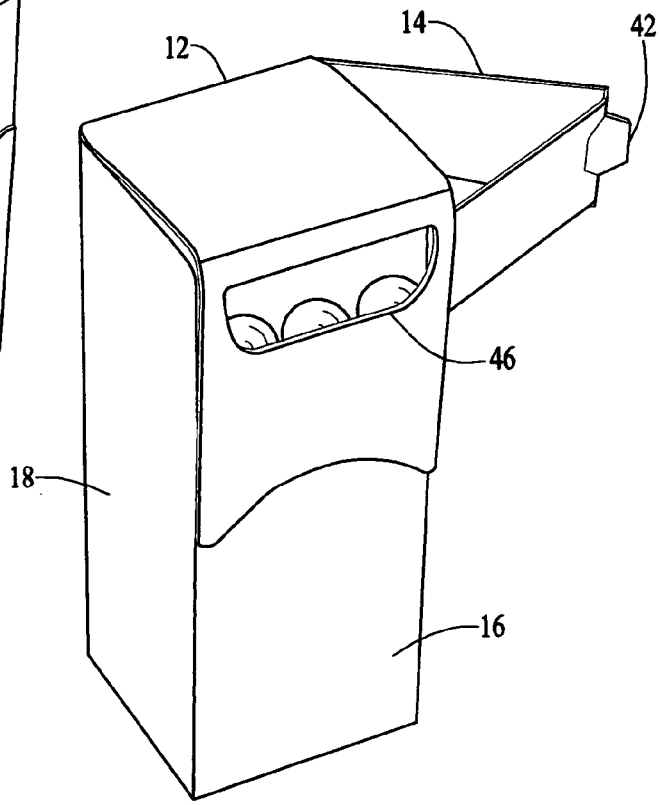
FIG. 5 is a front perspective view of the box showing operation of the sideways slider opening; and, FIG. 6 is a perspective view of the box in the user's right hand and product being dispensed.
Figure 6:
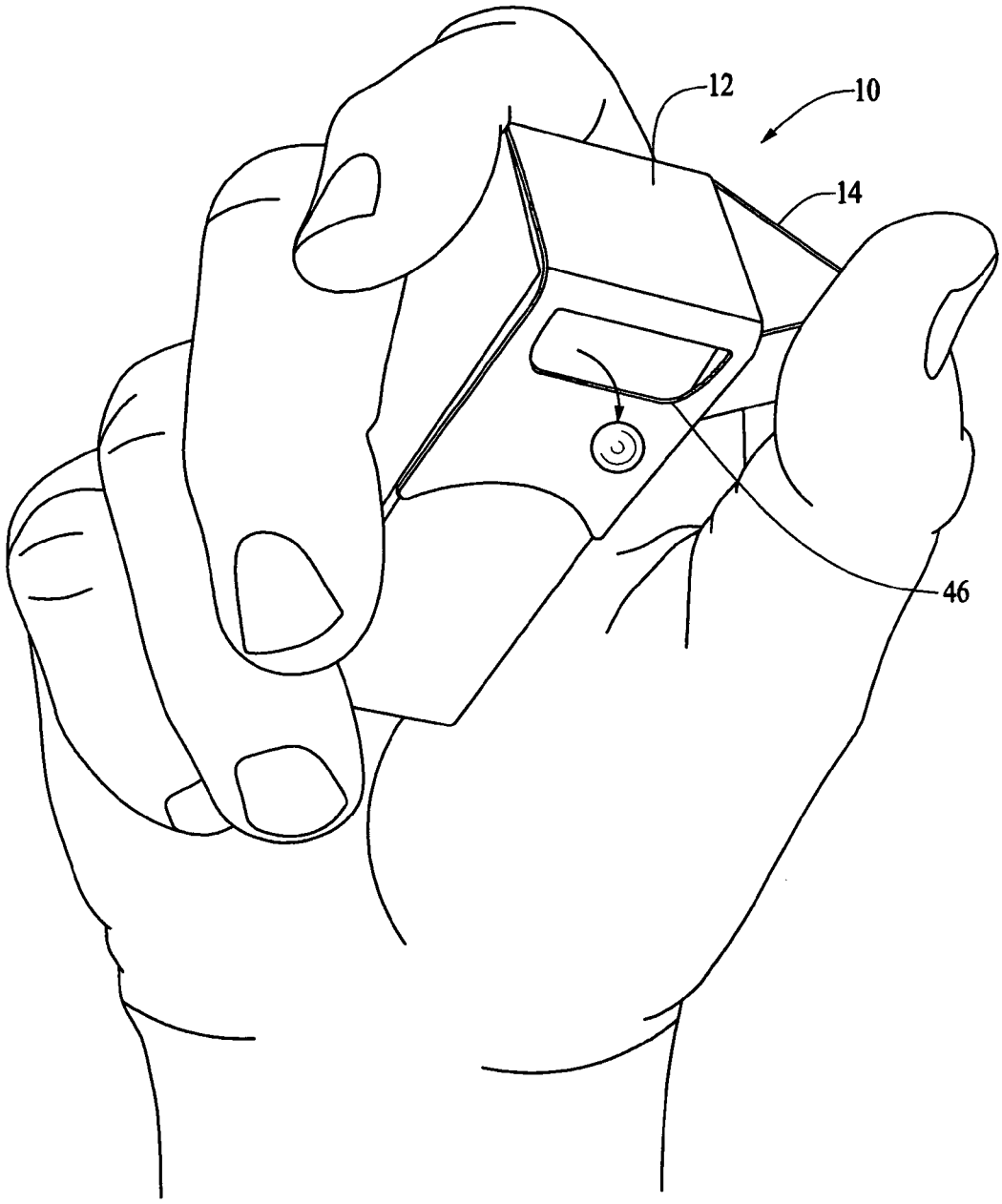

FIG. 4 shows the fully-constructed box 10 being filled from the bottom, which is preferred. FIG. 6 shows dispensing of product through the opening 46 after the slide 14 has been moved sideways unblocking the opening 46. While FIG. 6 shows the box 10 being held in the user's right hand, if the box 10 instead is in the user's left hand (not shown) it be turned about 90 degrees clockwise between the user's fingers and thumb, and then the user can use his or her left thumb to engage the slide tab 42 and move the slide 14 for dispensing of the product.

While particular forms of the invention have been illustrated and described, it will also be apparent to those skilled in the art that various modifications can be made without departing from the spirit and scope of the invention. Accordingly, it is not intended that the invention be limited except by the appended claims. For example, the box 10 could be made much larger in size and used for convenient cereal dispensing.

What is claimed is:

1. A package for dispensing solid pourable product comprising:

a. a box having at least one top flap, at least one bottom flap, and three or more major panels extending longitudinally therebetween, all foldably coupled together;

b. one of the major panels having a major panel opening proximate the top flap of the box and an underlying slide moveable sideways across the opening parallel to the top flap of the box;

c. the slide having a tab configured to be engaged by the user's thumb;

d. whereby the user may hold the box upright in the user's hand and at the same time, actuate the slide sideways with the user's thumb on the same hand, enabling dispensing of the contents of the box without the user's thumb blocking the opening; and e. wherein the slide is foldably coupled to one of the major panels of the box.

2. The package of claim 1 wherein the slide lies between the major panel of the box having the major panel opening and the top flap.

3. The package of claim 2 wherein the slide comprises at least one stop member, and the box comprises at least one corresponding catch member configured such that the slide is contained between the major panel of the box formed with the box opening and the top flap.

4. The package of claim 3 wherein the box is formed from a single blank piece of stock.

5. A package for dispensing solid pourable product comprising:

a. a box having at least one top flap, at least one bottom flap, and three or more major sides therebetween, the major sides forming a tubular structure having the top and bottom flaps foldably coupled thereto;

b. one of the major sides having a major side opening proximate the top flap of the box and an underlying slide moveable sideways across the opening parallel to the top flap of the box;

c. the slide having a tab configured to be engaged by the user's thumb;

d. whereby the user may hold the box upright in the user's hand and at the same time, actuate the slide sideways with the user's thumb on the same hand, enabling dispensing of the contents of the box without the user's thumb blocking the opening; and e. wherein the slide is foldably coupled to one of the major sides of the box.

6. The package of claim 5 wherein the slide lies between the major side of the box having the major side opening and the top flap.

7. The package of claim 6 wherein the slide comprises at least one stop member, and the box comprises at least one corresponding catch member configured such that the slide is contained between the major side of the box formed with the box opening and the top flap.

8. The package of claim 7 wherein the box is formed from a single blank piece of stock.

* * * * *